US012161174B2

(12) United States Patent
Moldstad

(10) Patent No.: US 12,161,174 B2
(45) Date of Patent: Dec. 10, 2024

(54) THERMALLY RE-CASTABLE BRASSIERES

(71) Applicant: Judith Racicot Moldstad, Brewster, MA (US)

(72) Inventor: Judith Racicot Moldstad, Brewster, MA (US)

( * ) Notice: Subject to any disclaimer, the term of this patent is extended or adjusted under 35 U.S.C. 154(b) by 0 days.

(21) Appl. No.: 18/091,298

(22) Filed: Dec. 29, 2022

(65) Prior Publication Data

US 2023/0225424 A1 Jul. 20, 2023

Related U.S. Application Data

(60) Provisional application No. 63/294,473, filed on Dec. 29, 2021.

(51) Int. Cl.
*A41C 3/12* (2006.01)

(52) U.S. Cl.
CPC ..... *A41C 3/12* (2013.01)

(58) Field of Classification Search
CPC ..... A41C 3/12
USPC ..... 2/255
See application file for complete search history.

(56) References Cited

U.S. PATENT DOCUMENTS 9,474,309 B2 * 10/2016 Yip ..... A41C 3/02
2009/0092807 A1 * 4/2009 Hu ..... B29C 61/003 156/60
2010/0196705 A1 * 8/2010 Hood ..... B29C 73/10 428/347

* cited by examiner

*Primary Examiner* — Gloria M Hale
(74) *Attorney, Agent, or Firm* — JWIP & Patent Services, LLC; Jacob G. Weintraub, Esq.

(57) ABSTRACT

The present invention is directed to thermally re-castable brassieres that offer the user the ability to personalize/customize the fit of the brassiere, multiple times, to account for changing body shape. In particular, the brassieres of the present invention are thermally re-castable through the inclusion of a thermally re-castable underwire positioned at the base of the cups. In addition, the thermally re-castable underwire of the present invention may be applied to existing brassieres and supportive garments by modification of these brassieres and garments.

22 Claims, 1 Drawing Sheet

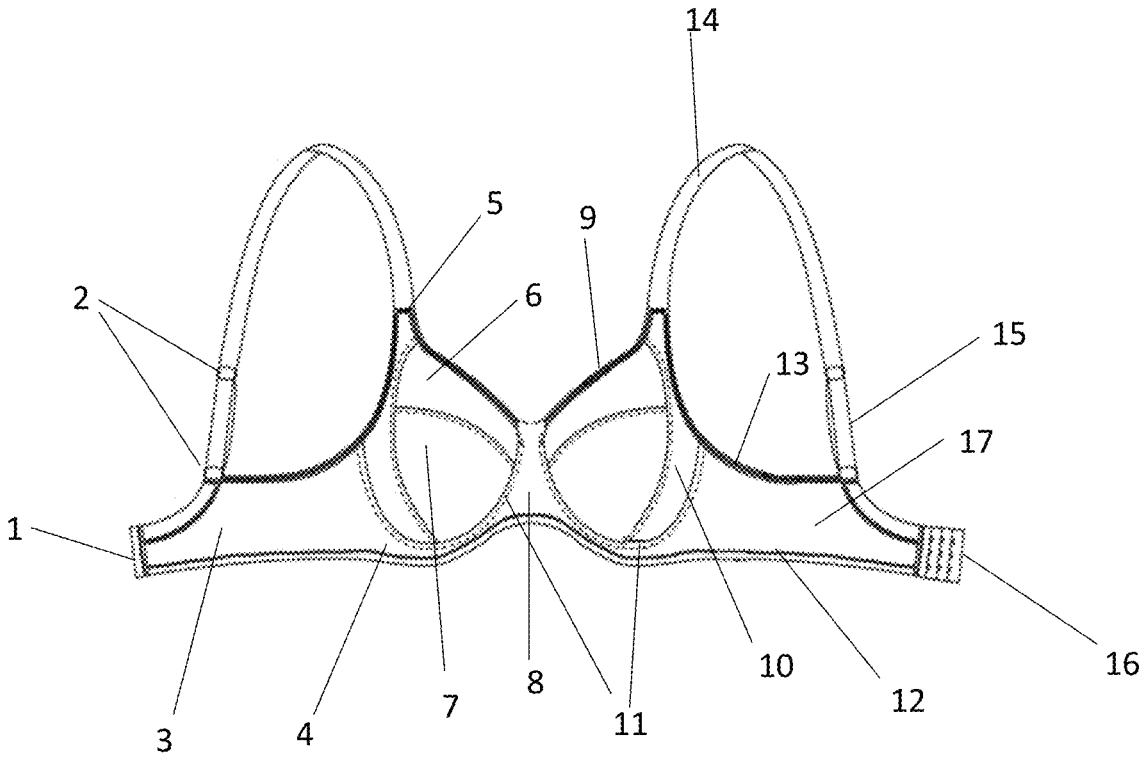
14
5
9
2
6
15
13
17
1
16
10
12
8
7
11
3
4

THERMALLY RE-CASTABLE BRASSIERES

RELATED APPLICATIONS

This application claims priority to U.S. Provisional Patent Application No. 63/294,473, filed on Dec. 29, 2021; the entirety of which is incorporated herein by reference.

BACKGROUND OF THE INVENTION

Modern brassieres (otherwise known colloquially as a "bras") are designed to balance comfort with support. As there is no ideal bra for every occasion, generally, women purchase several types of bras to account for the occasion or for utilitarian reasons; favoring support over comfort or comfort over support for a given situation. Given the variety needed, and the everyday use of these undergarments, the expense burden becomes significant.

Furthermore, weight and body shape changes are very common for women throughout the year (and over the course of years) and are a separate complication, which results in bras that no longer feel comfortable to the user. In this respect, the average consumer is forced to either suffer with the lack of comfort or expend additional cost to purchase the same variety of bra types a second, third, or nth time.

Advancements in the brassiere market have occurred over generations. Changes to the materials, design, and overall fit have yielded improvements in support, longevity, and comfort. Still more recent advantages include the ability for one-time customization, where the bra construction offers the user the ability to customize a bra to personalize for body shape and increase support related to their individual body, for example related to cup/padding molding. However, these customizable options are limited and are afforded to the user only at the outset, still leaving the user to purchase additional brassieres if a change in body shape/size occurs.

As such, there remains a clear need for alternative brassieres that offer the user the ability to personalize/customize the fit of the brassiere multiple times to account for changing body shape. Further, there is also a need for such customization to be applicable to existing brassieres and supportive garments by modification of these brassieres and garments.

SUMMARY OF THE INVENTION

Accordingly, the present invention is directed to thermally re-castable brassieres that offer the user the ability to personalize/customize the fit of the brassiere, multiple times, to account for changing body shape. In particular, the brassieres of the present invention are thermally re-castable through the inclusion of a thermally re-castable underwire positioned at the base of the cups. In addition, the thermally re-castable underwire of the present invention may be applied to existing brassieres and supportive garments by modification of these brassieres and garments.

As such, one aspect of the present invention provides a thermally re-castable brassiere comprising: two cups operationally associated with each other through a bridge structure; a closing fastener positioned on a first wing band suitable for reversibly fastening to a fastener pairing component on a second wing band, wherein the first wing band is operationally associated with one cup and the second wing band is operationally associated with the other cup, and wherein the wing bands are suitable in length to wrap around the torso of a user bringing the closing fastener and the fastener pairing component in proximity to each to achieve fastening; and a thermally re-castable underwire positioned at the base of the two cups.

Another aspect of the present invention provides a thermally re-castable sleeve channel designed to modify a brassiere, comprising a sleeve channel containing a thermally re-castable wire and a brassiere mounting harness suitable for mounting the sleeve channel to a brassiere positioned at the base of the cups of the brassiere to serve as underwire.

BRIEF DESCRIPTION OF THE FIGURES

Advantages of the present apparatus will be apparent from the following detailed description, which description should be considered in combination with the accompanying FIGURES, which are not intended limit the scope of the invention in any way.

FIG. 1 depicts a front view of certain embodiments of the thermally re-castable brassieres of the present invention.

DETAILED DESCRIPTION OF THE INVENTION

Brassieres, or bras, are commonly worn by women to provide support for their breasts and for enhanced shape and appearance. Women often find that not only do they need to buy a variety of types of bras for different uses and occasions but often must buy additional bras to accommodate the changing size and shape of their bodies, compounding the costs of these garments. In effort to avoid these burdensome costs, the present invention is directed to thermally re-castable brassieres that offer the user the ability to personalize/customize the fit of the brassiere, multiple times, to account for changing body shape. In particular, the brassieres of the present invention are thermally re-castable through the inclusion of a thermally re-castable underwire positioned at the base of the cups. In addition, the thermally re-castable underwire of the present invention may be applied to existing brassieres and supportive garments by modification of these brassieres and garments.

The brassieres of the present invention afford a continued custom fit by utilizing re-casting of the thermally re-castable underwire incorporated into the brassieres of the present invention. As such, the user of the thermally re-castable brassieres of the present invention enjoy an on-going customizable experience that accounts for changing body shapes.

The present invention, including thermally re-castable brassieres, and thermally re-castable sleeve channels designed to modify existing brassieres and supportive garments, will be described with reference to the following definitions that, for convenience, are set forth below. Unless otherwise specified, the below terms used herein are defined as follows:

I. Definitions

As used herein, the term "a," "an," "the" and similar terms used in the context of the present invention (especially in the context of the claims) are to be construed to cover both the singular and plural unless otherwise indicated herein or clearly contradicted by the context.

The term "about" is used herein in reference to the degree or extent of the term which it modifies, and that such extent may be 100% or near to but not exactly 100% of the modified term; industry accepted standards will assist in defining the quantitative aspects of how "near" 100% is defined. In particular embodiments, the term "about" indicates ±3%, ±2%, ±1% or ±0.5%. In a particular embodiment, for example, the language "about 60 degrees" would be exactly 60 degrees. In one alternative particular embodiment, for example, the language "about 60 degrees" would mean 60 degrees±2%.

The terms "brassiere" or "bra" are used interchangeably herein, which are art-recognized and are used to describe an undergarment worn by a person to support the breasts of the person, e.g., designed to balance comfort with support. Certain examples of the bras of the present invention include, but are not limited to, a Push Up Bra, a Padded Bra, a T-shirt Bra, a Convertible Bra, a Strapless Bra, a Balconette Bra, a Bandeau Bra, a Bralette, a Sports Bra, a Plunge Bra, a Stick-On Bra, a Mastectomy Bra, a Maternity Bra, a Minimizer Bra, a No Sag Bra, a Cami Bra, a Longline Bra, and a Cage Bra The term "fasten" is used herein to describe the act of making fast or securing against opening or separating. In certain embodiments, a mechanism used to fasten may include, for example, hook and loop (e.g., VELCRO®), a buckle, a tie, a zipper, a ratchet-type binding, tape, button, hook and eye, adhesive, a snap, and the like, or any combination thereof.

The "mounting harness" is used herein to describe the connective set of fittings or fastening mechanism that temporarily or permanently affix one item to another item, e.g., the brassiere mounting harness of the present invention suitable for mounting the sleeve channel to a brassiere positioned at the base of the cups of the brassiere to serve as underwire. In particular embodiments, the brassiere mounting harness may be selected from a strap, a buckle, an adhesive, a hook and an eye, a hook and loop (e.g., VELCRO®), or any combination thereof.

The term "operationally associated" is used herein to describe items that are associated, connected, or related in such a manner as to achieve a common intended purpose of operation of the items together. For example, the two cups of the brassiere may be operationally associated with each other such that the two components are connected in such a way, e.g., through a bridge structure, to afford the ability of the cups, working together to cover and support the breasts of the user.

The term "polycaprolactone (PCL)" is art-recognized, and describes a biodegradable polyester with a low melting point of about 60° C. and a glass transition temperature of about −60° C.

The language "power bar/sling" is art-recognized, and describes the portion of the cup that is the vertical section along the side of the upper and lower cup, which provides lift and support to the bust, e.g., as it spans the area between the apex and the thermally re-castable underwire of the present invention.

As used herein, the term "reversible," describes any mechanism or action that may be utilized to repeatably place a given item or items in one of two possible states, indefinitely. For example, a closing fastener positioned on a first wing band may be fastened or unfastened, to a fastener pairing component on a second wing band; this fastening is considered reversible.

The language "thermally re-castable" is used herein to describe the characteristic of a material or an item that may be cast into a shape using thermal energy, e.g., by heating. Once cast into the shape and subsequent to the removal of the thermal energy, the cast shape is suitable to provide a sufficiently rigid structure to maintain the shape under normal conditions of use. Such casted shape may be cast one or more additional times, i.e., re-cast, by the application of thermal energy, followed by the removal of the thermal energy. In certain embodiments, the thermal re-castable characteristic may be used for personalization/customization, as described herein. Moreover, the thermal energy useful for re-casting may be derived from heating directly or indirectly. In particular embodiments, the thermal energy is microwave, e.g., derived from a microwave oven. In other particular embodiments, the thermal energy may be provided by a hair dryer, e.g., heating the thermally re-castable material to a temperature sufficient to afford the ability to cast into a shape.

The term "wire" is used herein in reference to the term "underwire," which is art-recognized and describes the wire running through the underside of each cup of a brassiere, i.e., to aid in support and structure. The underwire may comprise one or more segments of wire. In certain embodiments, the underwire is sewn into the underside of each cup of a brassiere. In certain alternative embodiments, the underwire is placed into a sleeve channel designed to modify a brassiere, i.e., positioned on the underside of each cup of a brassiere. In particular embodiments, the underwire is a semicircular wire support.

II. Thermally Re-Castable Brassieres of the Invention

The present invention described herein relates to novel brassieres that offer the user the ability to personalize/customize the fit of the brassiere multiple times, to account for changing body shape. This on-going customizable experience to accommodate changing shapes is afforded by utilizing the re-casting (i.e., at will) of the thermally re-castable underwire incorporated into the brassieres of the present invention. In particular, the brassieres of the present invention are thermally re-castable through the inclusion of a thermally re-castable underwire positioned at the base of the cups.

As such, one embodiment of the present invention provides a thermally re-castable brassiere comprising:

two cups operationally associated with each other through a bridge structure, i.e. capable of being fastened to the user of the brassiere (e.g., through a fastening mechanism that fastens one cup side to the other around the torso of the user, or fastens directly to the user through adhesion); and a thermally re-castable underwire (e.g., inside a fabric sleeve channel, e.g., a removable sleeve) positioned at the base of the two cups.

Another embodiment of the present invention provides a thermally re-castable brassiere comprising:

two cups operationally associated with each other through a bridge structure;

a closing fastener (e.g., a hook) positioned on a first wing band suitable for reversibly fastening to a fastener pairing component (e.g., a loop) on a second wing band, wherein the first wing band is operationally associated with one cup and the second wing band is operationally associated with the other cup, and wherein the wing bands are suitable in length to wrap around the torso of a user bringing the closing fastener and the fastener pairing component in proximity to each to achieve fastening; and a thermally re-castable underwire (e.g., inside a fabric sleeve channel, e.g., a removable sleeve) positioned at the base of the two cups.

In certain embodiments of the present invention, the thermally re-castable brassiere of the present invention is formed in a brassiere style selected from the group consisting of Push Up Bra, Padded Bra, T-shirt Bra, Convertible Bra, Strapless Bra, Balconette Bra, Bandeau Bra, Bralette, Sports Bra, Plunge Bra, Stick-On Bra, Mastectomy Bra, Maternity Bra, Minimizer Bra, No Sag Bra, Cami Bra, Longline Bra, and Cage Bra.

A. Thermally Re-Castable Underwire

The thermally re-castable brassieres of the present invention comprise a thermally re-castable underwire positioned at the base of the two cups. In certain embodiments, the underwire is positioned at the base of the cups to provide support and structure for the bra. In particular embodiments, the thermally re-castable underwire is sewn into the thermally re-castable brassieres of the present invention, e.g., inside a fabric sleeve channel suitable for containing the thermally re-castable underwire. In alternative particular embodiments, the thermally re-castable underwire is removable from the thermally re-castable brassieres of the present invention, e.g., inside a removable fabric sleeve channel suitable for containing the thermally re-castable underwire (e.g., for washing purposes).

In certain embodiments of the present invention, the thermally re-castable brassiere further comprises a sleeve channel that contains the thermally re-castable underwire. In certain embodiments, the sleeve channel is a fabric sleeve channel. In certain embodiments, the sleeve channel is removable.

In certain embodiments of the present invention, the thermally re-castable underwire is a polymer, e.g., biodegradable polymer, with a melting point of under about 100° C., e.g., under about 90° C., e.g., under about 80° C., e.g., under about 70° C., e.g., under about 65° C., e.g., under about 60° C.

In certain embodiments of the present invention, the thermally re-castable underwire is a polyester, e.g., biodegradable polyester, with a melting point of under about 100° C., e.g., under about 90° C., e.g., under about 80° C., e.g., under about 70° C., e.g., under about 65° C., e.g., under about 60° C. In certain embodiments of the present invention, the thermally re-castable underwire is comprised of polycaprolactone. In particular embodiments, the thermally re-castable underwire is comprised of polyplastic beads, e.g., molded/casted polyplastic beads.

B. Cups

The thermally re-castable brassieres of the present invention comprise two cups operationally associated with each other through a bridge structure. The bridge is the center point of the bra between the cups, i.e., the span between the cups. The seams in the bra cups may vary depending on function and style preferences. As such, in certain embodiments, the bra of the invention comprises one or more seams in the cup. In certain other embodiments, the cups of the bras of the invention are molded and seamless.

In certain embodiments of the thermally re-castable brassieres of the present invention, the bridge is adjustable. In certain embodiments, the bridge of the bra is adjusted to be narrower or wider according to breast placement on the chest of the user, where the most comfortable fit places the bridge in a manner that sits flat on the chest body to fit between the cups. In particular embodiments, the top of the bridge is decorated by a decorative bow.

In certain embodiments of the thermally re-castable brassieres of the present invention, each cup is comprised of an upper cup and a lower cup. In certain embodiments, the lower cup comprises a push-up effect, e.g., containing foam.

In certain embodiments of the thermally re-castable brassieres of the present invention, each cup is comprised of an upper cup, a lower cup, and a power bar/sling, i.e., which together make up the complete cup. In certain embodiments, the lower cup is sewn into the upper cup and to the power bar/sling to form the complete cup. This area provides support for the bust of the user and, in certain embodiments, may contain foam for a push-up effect.

C. Fastener

In certain embodiments of the present invention, the thermally re-castable brassieres of the present invention comprise a closing fastener (e.g., a hook) positioned on a first wing band suitable for reversibly fastening to a fastener pairing component (e.g., a loop, e.g., 'eyes') on a second wing band. In certain embodiments, the closing fastener and the fastener pairing component are designed to reversibly fasten to each other to serve as a two-part fastener (i.e., two ends being used to connect to create the act of fastening) for closing the thermally re-castable brassieres of the present invention. The first wing band, on which the closing fastener is positioned, is operationally associated with one cup and the second wing band, on which the fastener pairing component is positioned, is operationally associated with the other cup. Further, the wing bands are suitable in length to wrap around the torso of a user bringing the closing fastener and the fastener pairing component in proximity to each to achieve fastening. Moreover, the wing band, in certain embodiments, is designed to wrap around the torso and provide a snug fit (i.e., on the user) between the cups and the closing fastener and fastener pairing component, respectively.

In certain embodiments of the thermally re-castable brassiere of the present invention, the closing fastener is a hook (e.g., one or more hooks) positioned on a first wing band suitable for reversibly fastening to a corresponding fastener pairing component. In particular embodiments, one or more hooks link into the corresponding fastener pairing component, e.g., eyes, to close or fasten the bra at the center back. In specific embodiments, the hooks and fastener pairing components are found in one, two or three vertical rows.

In certain embodiments of the thermally re-castable brassiere of the present invention, the fastener pairing component is an eye loop positioned on the second wing band suitable for reversibly fastening to the closing fastener. In particular embodiments, one or more eyes link to the closing fastener, e.g., hooks, to close or fasten the bra at the center back. In specific embodiments, the eyes and closing fastener are found in one, two or three vertical rows.

D. Additional Components

The thermally re-castable brassieres of the present invention may also comprise additional components. In certain embodiments, the thermally re-castable brassieres of the present invention comprise a strap adjustment ring and slider, a neckline, a frame, an apex, an underarm, an under band, a strap (e.g., a strap front and a strap back), and any combination thereof In certain embodiments the thermally re-castable brassieres of the present invention comprise a strap, e.g., connected to the apex of each of the cups. In certain embodiments, the strap further comprises a strap adjustment ring and slider for each strap. In particular embodiments, the strap front is the portion of the strap that spans the distance from the apex to the adjustment rings and sliders. In particular embodiments, the strap back is the portion of the strap between the strap adjustment rings and sliders, connecting the strap front and the wings/bands.

In certain embodiments the thermally re-castable brassieres of the present invention comprise one or more strap adjustment rings and sliders. In certain embodiments, the strap adjustment rings and sliders may be placed at the back of the bra. In certain other embodiments, the strap adjustment rings and sliders may be placed at the front of the bra.

The strap adjustment rings and sliders join the strap front to the strap back and allow the wearer to adjust the straps to fit their body comfortably.

In certain embodiments the thermally re-castable brassieres of the present invention comprise a frame. The frame is the front of the bra where the cups are sewn into the bra, connecting the bridge structure to the wing bands.

In certain embodiments the thermally re-castable brassieres of the present invention comprise an apex. The apex is the point where the cups join the strap front. In certain embodiments, the apex connection is made by being sewn together directly. In certain embodiments, the apex connection is made by being joined with a decorative ring.

In certain embodiments the thermally re-castable brassieres of the present invention comprise a neckline. The neckline is the area of a brassiere that is along the front of the bra down the chest. In certain embodiments, the neckline is finished with elastic. In certain other embodiments, the upper cup has a decorative edge (e.g., decorative detailing like scalloped edge lace), in which case the fabric's edge would be along the top edge of the upper cup along the neckline.

In certain embodiments the thermally re-castable brassieres of the present invention comprise an under band. The under band is the lowest-most portion of the bra, along the bottom edge of the wing band and frame. This edge, much like the neckline, may be either finished with elastic or decorative lace.

In certain embodiments the thermally re-castable brassieres of the present invention comprise an underarm. The underarm is the span of the bra that spans the distance between the apex and the strap back and fits snug under the arm on the body of the user. In certain embodiments, the underarm is finished with elastic.

In certain embodiments the thermally re-castable brassieres of the present invention comprises trenslo boning in the wing bands. The trenslo boning is used in the wing bands to strengthen the wing band fabric and reduce collapse for larger cup support.

III. Thermally Re-Castable Sleeve Channels of the Invention

Another embodiment of the present invention provides a thermally re-castable sleeve channel designed to modify a brassiere, comprising a sleeve channel containing a thermally re-castable wire and a brassiere mounting harness suitable for mounting the sleeve channel to a brassiere positioned at the base of the cups of the brassiere to serve as underwire.

In certain embodiments of the present invention, the brassiere (i.e., the modified brassiere) is selected from the group consisting of Push Up Bra, Padded Bra, T-shirt Bra, Convertible Bra, Strapless Bra, Balconette Bra, Bandeau Bra, Bralette, Sports Bra, Plunge Bra, Stick-On Bra, Mastectomy Bra, Maternity Bra, Minimizer Bra, No Sag Bra, Cami Bra, Longline Bra, and Cage Bra.

In certain embodiments of the present invention, the sleeve channel is a fabric sleeve channel.

In certain embodiments of the present invention, the sleeve channel is reversibly mountable to the brassiere through the brassiere mounting harness. In certain embodiments, the brassiere mounting harness may be selected from the group consisting of a strap, a buckle, an adhesive, a hook and an eye, a hook and loop (e.g., VELCRO®), and any combination thereof.

In certain embodiments of the present invention, the thermally re-castable underwire is a polyester, e.g., a biodegradable polyester, with a melting point of under about 100° C., e.g., under about 90° C., e.g., under about 80° C., e.g., under about 70° C., e.g., under about 65° C., e.g., under about 60° C. In certain embodiments of the present invention, the thermally re-castable underwire is comprised of polycaprolactone. In particular embodiments, the thermally re-castable underwire is comprised of polyplastic beads, e.g., molded/casted polyplastic beads.

IV. Methods of the Invention

A. Methods of Preparation

The material composition of the underwire of the present invention is thermally re-castable, e.g., re-castable by heating. In certain embodiments of the present invention, the thermally re-castable underwire is a polymer, e.g., biodegradable polymer, with a melting point of under about 100° C., e.g., under about 90° C., e.g., under about 80° C., e.g., under about 70° C., e.g., under about 65° C., e.g., under about 60° C. In certain embodiments of the present invention, the thermally re-castable underwire is a polyester, e.g., a biodegradable polyester, with a melting point of under about 100° C., e.g., under about 90° C., e.g., under about 80° C., e.g., under about 70° C., e.g., under about 65° C., e.g., under about 60° C. In certain embodiments of the present invention, the thermally re-castable underwire is comprised of polycaprolactone in part or in whole. Being compatible with a range of other materials, polycaprolactone may be combined with other materials in a manner that does not prevent the material from achieving its desired function as described herein (e.g., to add properties to the material, e.g., to alter biodegradability or melting point temperature); for example, polycaprolactone may be mixed with starch to lower its cost and increase biodegradability. In particular embodiments, the thermally re-castable underwire is comprised of polyplastic beads, e.g., molded/casted polyplastic beads.

It should be readily understood by the ordinarily skilled artisan in light of the disclosure provided herein that the remainder of the components of the brassieres of the present invention may be constructed in accordance with known methods, with the exception of the thermally re-castable underwire. As such, the brassieres of the present invention can be manufactured in a variety of shapes and sizes, and can be formed from a variety of materials, such as fabric, stitching, metals, resins, or plastic materials, as well as other suitable materials or combinations thereof. Moreover, the forming process of the final assembled brassiere or sleeve channel can also vary to include methods such as mild thermoforming or other heat application to shape the thermally re-castable underwire. In certain embodiments, the thermally re-castable underwire can be transparent, translucent, or opaque, and may be colored in any instance.

The underwire is positioned at the base of the cups to provide support and structure for the bra. In particular embodiments, the thermally re-castable underwire is sewn into the thermally re-castable brassieres of the present invention, e.g., inside a fabric sleeve channel suitable for containing the thermally re-castable underwire. In alternative particular embodiments, the thermally re-castable underwire is manufactured to be removable from the thermally re-castable brassieres of the present invention, e.g., inside a removable fabric sleeve channel suitable for containing the thermally re-castable underwire (e.g., for washing purposes).

B. Methods of Indefinite Personalizing/Customizing of a Brassiere

Another embodiment of the present invention provides a method of indefinite or unlimited personalization/customization of a brassiere comprising the step of incorporating a thermally re-castable underwire of the present invention into a brassiere, such that the personalizing/customizing capabilities of the brassiere is made indefinite or unlimited. In a particular embodiment of the present invention, the present invention provides a method of indefinite or unlimited personalization/customization of a brassiere comprising the step of incorporating a thermally re-castable underwire of the present invention into a brassiere in a sleeve channel (e.g., sewn into the brassiere), such that the personalizing/customizing capabilities of the brassiere is made indefinite or unlimited.

Such methods afford the ability to personalize/customize the fit of the brassiere, an indefinite or unlimited number of times, to account for changing body shape. In particular, the brassieres of the present invention are thermally re-castable through the inclusion of a thermally re-castable underwire positioned at the base of the cups. In addition, the thermally re-castable underwire of the present invention may be applied to existing brassieres and supportive garments by modification of these brassieres and garments.

V. Design Aspects of the Invention

Independent of the utility related to the brassieres of the present invention, the ornamental appearance of any novel design provided herein is intended to be part of this invention, for example, the view in FIG. 1, which may form an independent or combined ornamental appearance of the brassieres described herein.

Accordingly, one embodiment of the present invention provide an ornamental design for a brassieres comprising an thermally re-castable underwire positioned at the base of the two cups of the present invention as shown and described.

EXEMPLIFICATION

Having thus described the invention in general terms, reference will now be made to the accompanying drawings of exemplary embodiments, which are not necessarily drawn to scale, and which are not intended to be limiting in any way.

In this respect, it is to be understood that the invention is not limited in its application to the details of construction and to the arrangements of the components set forth in the description provided herein or illustrated in the FIGURE. The invention is capable of other embodiments and of being practiced and carried out in various ways. Also, it is to be understood that the phraseology and terminology employed herein are for the purpose of description and should not be regarded as limiting.

Example 1

Structure of Example of Brassieres of the Present Invention

The structure of an exemplary thermally re-castable brassiere of the present invention is depicted in FIG. 1, which depicts a front view of certain embodiments of the thermally re-castable brassieres of the present invention.

In FIG. 1, each of the two cups shown are comprised of an upper cup 6, a lower cup 7, and a power bar/sling 10, i.e., which together make up the complete cup. In particular, the lower cup 7 is sewn into the upper cup 6 and to the power bar/sling 10 to form the complete cups. The two cups are operationally associated with each other through a bridge structure 8, which is the center point (area) of the bra between the cups. The cups are sewn into the bra at the front of the bra at frame 4 connecting the bridge structure to the wing bands.

A closing fastener 1 comprised of one or more hooks is positioned on a first wing band 3 suitable for reversibly fastening to a fastener pairing component 16 comprised of one or more loops on a second wing band 17, wherein the first wing band 3 is operationally associated with one cup and the second wing band 17 is operationally associated with the other cup, and wherein the wing bands are suitable in length to wrap around the torso of a user bringing the closing fastener 1 and the fastener pairing component 16 in proximity to each to achieve fastening.

The thermally re-castable underwire 11 is positioned at the base of the two cups, and is sewn into the brassiere.

The apex 5 joins the strap front 14 by being sewn together directly. The sliders 2 join the strap front 14 to the strap back 15 and allow the wearer to adjust the straps to fit their body comfortably.

The neckline 9, the area of a brassiere that is along the front of the bra down the chest is finished with elastic. The under band 12, the lowest-most portion of the bra along the bottom edge of the wing band and frame is also finished with elastic. The underarm 13, the span of the bra that spans the distance between the apex and the strap back and fits snug under the arm on the body of the user is also finished with elastic.

Example 2

Examples of Brassieres of the Present Invention

Brassieres of the present invention may be formed into the brassiere style initially upon creation, or may be formed as a modification of an existing brassiere though addition of a thermally re-castable sleeve channel of the present invention designed to modify the brassiere.

In certain embodiments of the present invention, the thermally re-castable brassiere of the present invention is formed in a brassiere style selected from the group consisting of Push Up Bra, Padded Bra, T-shirt Bra, Convertible Bra, Strapless Bra, Balconette Bra, Bandeau Bra, Bralette, Sports Bra, Plunge Bra, Stick-On Bra, Mastectomy Bra, Maternity Bra, Minimizer Bra, No Sag Bra, Cami Bra, Longline Bra, and Cage Bra.

Push Up Bra

In certain embodiments of the present invention, the bra style may be a push-up bra. The push-up bra, also known as the lift-up bras, is padded on the under-side of the cups with either silicone gel or foam to lift up the breast tissue, and may come in different levels of push up, e.g., pushing the breasts upwards and moving them close together to provide cleavage. In particular embodiments of the present invention, the thermally re-castable underwire is positioned at the base of the two cups, e.g., either sewn in or mounted on a bra without underwire in a thermally re-castable sleeve channel with a mounting harness.

Padded Bra

In certain embodiments of the present invention, the bra style may be a padded bra. In the padded bra, the padded cups of the bra prevent nipple show under T-shirts and fitted outfits and may have different necklines and coverages for different sized breasts. The padded bras of the present invention are underwired for added support. In particular embodiments of the present invention, the thermally re-castable underwire is positioned at the base of the two cups, e.g., either sewn in or mounted on a bra without underwire in a thermally re-castable sleeve channel with a mounting harness.

T-Shirt Bra

In certain embodiments of the present invention, the bra style may be a T-shirt bra. In the T-shirt bra, the stylish and functional bra provides a padded bra design for everyday comfort (i.e., padded to different extents), and designed to go invisible under body-hugging outfits (e.g., with seamless, smooth cups that do not show and support the bust gently). In certain embodiments the T-shirt bra comes in a variety of styles, from strapless to plunge. In particular embodiments of the present invention, the thermally re-castable underwire is positioned at the base of the two cups, e.g., either sewn in or mounted on a bra without underwire in a thermally re-castable sleeve channel with a mounting harness.

Convertible Bra

In certain embodiments of the present invention, the bra style may be a convertible bra. The convertible bra, also known as the multi-way bra, comes with detachable straps that can be re-arranged in multiple ways by hooking them onto different slots at the front or the back, e.g., one-strap, two-straps, strapless or cross-back. In particular embodiments of the present invention, the thermally re-castable underwire is positioned at the base of the two cups, e.g., either sewn in or mounted on a bra without underwire in a thermally re-castable sleeve channel with a mounting harness.

Strapless Bra

In certain embodiments of the present invention, the bra style may be a strapless bra. The strapless bra is a bra without straps, e.g., for shoulder-baring outfits. The two cups of the strapless bra are held in place by a strong, wired under band. In certain embodiments, some multi-way bras, with detachable bra straps, may be considered strapless bras. In particular embodiments of the present invention, the thermally re-castable underwire is positioned at the base of the two cups, e.g., either sewn in or mounted on a bra without underwire in a thermally re-castable sleeve channel with a mounting harness.

Balconette Bra

In certain embodiments of the present invention, the bra style may be a balconette bra. The balconette bra is very delicate lingerie style bra that gives a gentle lift and a rounded appearance to the bust. In certain embodiments, with wide set straps and cups that form an almost horizontal neckline (i.e., similar in appearance to a balcony) this bra can stay hidden under the widest of necks. In particular embodiments of the present invention, the thermally re-castable underwire is positioned at the base of the two cups, e.g., either sewn in or mounted on a bra without underwire in a thermally re-castable sleeve channel with a mounting harness.

Bandeau Bra

In certain embodiments of the present invention, the bra style may be a bandeau bra. In the bandeau bra, which is a cross between a strapless bra and a tube top, the bandeau is a band or a strip of stretchable fabric that can be pulled onto the bust over the head. The bandeau bras of the present invention comprise cups. In particular embodiments of the present invention, the thermally re-castable underwire is positioned at the base of the two cups, e.g., either sewn in or mounted on a bra without underwire in a thermally re-castable sleeve channel with a mounting harness.

Bralette

In certain embodiments of the present invention, the bra style may be a bralette. In the bralette, the stylish bra is designed with minimal construction and can be slipped on easily and can be styled as both underwear and outerwear, e.g., with lace edges peeking out from under loose-fit tops and low necklines. The bralette bras of the present invention comprise cups. In particular embodiments of the present invention, the thermally re-castable underwire is positioned at the base of the two cups, e.g., either sewn in or mounted on a bra without underwire in a thermally re-castable sleeve channel with a mounting harness.

Sports Bra

In certain embodiments of the present invention, the bra style may be a sports bra, including variants such as the padded sports bras, compression or encapsulation sports bras, pull-over or back-clasp sports bras, etc. In the sports bra, the design is engineered to provide support to the breasts during workouts, e.g., engineered to prevent bounce and hold the bust firm during strenuous movement. In particular embodiments of the present invention, the thermally re-castable underwire is positioned at the base of the two cups, e.g., either sewn in or mounted on a bra without underwire in a thermally re-castable sleeve channel with a mounting harness.

Plunge Bra

In certain embodiments of the present invention, the bra style may be a plunge bra, including variants such as the deep plunge bra, multiway plunge bra, etc., based on bust type, outfit and style. In the plunge bra, with a deep bridge structure and cups that cut away on the sides, the bra easily moulds to the shape of the breast and is designed to show off cleavage under deep-neck outfits, e.g., this bra vanishes under low necklines, while giving a fuller appearance to the bust and cleavage. In particular embodiments of the present invention, the thermally re-castable underwire is positioned at the base of the two cups, e.g., either sewn in or mounted on a bra without underwire in a thermally re-castable sleeve channel with a mounting harness.

Stick-On Bra

In certain embodiments of the present invention, the bra style may be a stick-on bra, e.g., for backless and sheer-back outfits. In certain embodiments, the stick-on bra is designed with a gentle adhesive substance along the cups and wings, and glue seamlessly on to the curves of the user. In certain other embodiments, the stick-on bra may be a silicone stick-on bra, e.g., without side wings. In particular embodiments of the present invention, the thermally re-castable underwire is positioned at the base of the two cups, e.g., either sewn in or mounted on a bra without underwire in a thermally re-castable sleeve channel with a mounting harness.

Mastectomy Bra

In certain embodiments of the present invention, the bra style may be a mastectomy bra. The mastectomy bra is designed for women who've undergone a mastectomy without breast reconstruction, e.g., designed with silicone prosthesis pockets in each cup. In particular embodiments of the present invention, the thermally re-castable underwire is positioned at the base of the two cups, e.g., either sewn in or mounted on a bra without underwire in a thermally re-castable sleeve channel with a mounting harness.

Maternity Bra

In certain embodiments of the present invention, the bra style may be a maternity bra. In the maternity bra, the bra is designed to give extra comfort and support, having moulded cups of elastic, e.g., elastane, fabric to accommodate changing breast shape and size during pregnancy. Certain maternity bras are designed for baby feeding (also known as a feeding bra or nursing bra), designed with cups with easily removable flaps that can be unhooked to allow comfortable breast-feeding post pregnancy. In particular embodiments of the present invention, the thermally re-castable underwire is positioned at the base of the two cups, e.g., either sewn in or mounted on a bra without underwire in a thermally re-castable sleeve channel with a mounting harness.

Minimizer Bra

In certain embodiments of the present invention, the bra style may be a minimizer bra. In the minimizer bra, the bra is engineered to visually reduce the projection and circumference of the chest, by redistributing breast tissue to create the appearance of a smaller bust. In certain embodiments, this type of bra also provides the added benefit of extra support and shaping for a proportionate look. In particular embodiments of the present invention, the thermally re-castable underwire is positioned at the base of the two cups, e.g., either sewn in or mounted on a bra without underwire in a thermally re-castable sleeve channel with a mounting harness.

No Sag Bra

In certain embodiments of the present invention, the bra style may be a no-sag bra. The no-sag bra is highly functional and holds the breast tissue firmly in place. In certain embodiments, this bra is designed with high-strength, no-stretch fabric, e.g., with a reinforced frame, wide back and thick straps that work together to give a youthful lift and prevent sagging. In particular embodiments of the present invention, the thermally re-castable underwire is positioned at the base of the two cups, e.g., either sewn in or mounted on a bra without underwire in a thermally re-castable sleeve channel with a mounting harness.

Cami Bra

In certain embodiments of the present invention, the bra style may be a camisole or cami bra. The camisole bra is a combination of style and functionality (e.g., with the coverage of a camisole and the support of a bra), which features high necklines and full cups to conceal cleavage under deep neck outfits. In certain embodiments, the bra is underwired and padded to give a gently rounded lift, while others feature detachable straps for multiway styling. In particular embodiments of the present invention, the thermally re-castable underwire is positioned at the base of the two cups, e.g., either sewn in or mounted on a bra without underwire in a thermally re-castable sleeve channel with a mounting harness.

Longline Bra

In certain embodiments of the present invention, the bra style may be a longline bra. In the longline bra, the stylish and functional bra provides extended coverage from below the bust to a few inches above the belly button, e.g., wherein the additional band of material may assist in shaping the waist. In particular embodiments of the present invention, the thermally re-castable underwire is positioned at the base of the two cups, e.g., either sewn in or mounted on a bra without underwire in a thermally re-castable sleeve channel with a mounting harness.

Cage Bra

In certain embodiments of the present invention, the bra style may be a caged bra. In the caged bra, the stylized padded bra comprises a multi-strap designer back and neckline that are meant to be shown off as stylish, e.g., useful for low cut and sheer back outfits. In particular embodiments of the present invention, the thermally re-castable underwire is positioned at the base of the two cups, e.g., either sewn in or mounted on a bra without underwire in a thermally re-castable sleeve channel with a mounting harness.

INCORPORATION BY REFERENCE

The entire contents of all patents, published patent applications and other references cited herein are hereby expressly incorporated herein in their entireties by reference.

Equivalents

Those skilled in the art will recognize, or be able to ascertain using no more than routine experimentation, numerous equivalents to the specific procedures described herein. Such equivalents were considered to be within the scope of this invention and are covered by the following claims. Moreover, any numerical or alphabetical ranges provided herein are intended to include both the upper and lower value of those ranges. In addition, any listing or grouping is intended, at least in certain embodiments, to represent a shorthand or convenient manner of listing independent embodiments; as such, each member of the list should be considered a separate embodiment.

What is claimed is:

1. A thermally re-castable brassiere comprising:

two cups operationally associated with each other through a bridge spanning between one cup and a second cup;

a closing fastener positioned on a first wing band suitable for reversibly fastening to a fastener pairing component on a second wing band, wherein the first wing band is operationally associated with the one cup and the second wing band is operationally associated with the second cup, and wherein the wing bands wrap around a torso of a user bringing the closing fastener and the fastener pairing component in proximity to each to achieve fastening; and a thermally re-castable underwire positioned at a base of the two cups, castable into a shape by the application of thermal energy by the user to customize the fit of the brassiere and then castable one or more additional times by the application of thermal energy by the user to customize the fit of the brassiere to account for changing body shape.

2. The thermally re-castable brassiere of claim 1 further comprising a sleeve channel that contains the thermally re-castable underwire.

3. The thermally re-castable brassiere of claim 2, wherein the sleeve channel is a fabric sleeve channel.

4. The thermally re-castable brassiere of claim 2, wherein the sleeve channel is removable.

5. The thermally re-castable brassiere of claim 1 further comprising a strap connected to an apex of each of the cups.

6. The thermally re-castable brassiere of claim 5 further comprising a strap adjustment ring and slider for each strap.

7. The thermally re-castable brassiere of claim 1 further comprising a frame.

8. The thermally re-castable brassiere of claim 1, wherein the closing fastener is a hook positioned on a first wing band for reversibly fastening to the fastener pairing component.

9. The thermally re-castable brassiere of claim 1, wherein the fastener pairing component is an eye loop positioned on the second wing band for reversibly fastening to the closing fastener.

10. The thermally re-castable brassiere of claim 1, wherein each cup is comprised of an upper cup and a lower cup.

11. The thermally re-castable brassiere of claim 1, wherein the lower cup comprises a push-up effect.

12. The thermally re-castable brassiere of claim 1, wherein each cup further comprises a power bar/sling.

13. The thermally re-castable brassiere of claim 1, wherein the bridge is adjustable.

14. The thermally re-castable brassiere of claim 1, formed in a brassiere style selected from the group consisting of Push Up Bra, Padded Bra, T-shirt Bra, Convertible Bra, Strapless Bra, Balconette Bra, Bandeau Bra, Bralette, Sports Bra, Plunge Bra, Stick-On Bra, Mastectomy Bra, Maternity Bra, Minimizer Bra, No Sag Bra, Cami Bra, Longline Bra, and Cage Bra.

15. The thermally re-castable brassiere of claim 1, wherein the thermally re-castable underwire is a biodegradable polyester with a melting point of under 100° C.

16. The thermally re-castable brassiere of claim 1, wherein the thermally re-castable underwire is comprised of polycaprolactone.

17. A thermally re-castable sleeve channel designed to modify a brassiere, comprising a sleeve channel containing a thermally re-castable wire and a brassiere mounting harness for mounting the sleeve channel to a brassiere positioned at a base of two cups of the brassiere to serve as an underwire.

18. The thermally re-castable sleeve channel of claim 17, wherein the sleeve channel is a fabric sleeve channel.

19. The thermally re-castable sleeve channel of claim 17, wherein the sleeve channel is reversibly mountable to the brassiere through the brassiere mounting harness.

20. The thermally re-castable sleeve channel of claim 17, wherein the brassiere is selected from the group consisting of Push Up Bra, Padded Bra, T-shirt Bra, Convertible Bra, Strapless Bra, Balconette Bra, Bandeau Bra, Bralette, Sports Bra, Plunge Bra, Stick-On Bra, Mastectomy Bra, Maternity Bra, Minimizer Bra, No Sag Bra, Cami Bra, Longline Bra, and Cage Bra.

21. The thermally re-castable sleeve channel of claim 17, wherein the thermally re-castable wire is a biodegradable polyester with a melting point of under 100° C.

22. The thermally re-castable sleeve channel of claim 17, wherein the thermally re-castable wire is comprised of polycaprolactone.

* * * * *